US005415571A

United States Patent [19]

Lutsch

[11] Patent Number: 5,415,571

[45] Date of Patent: May 16, 1995

[54] RECEPTACLE FOR A CONNECTOR

[75] Inventor: Harald M. Lutsch, Dietzenbach, Germany

[73] Assignee: The Whitaker Corporation, Wilmington, Del.

[21] Appl. No.: 35,515

[22] Filed: Mar. 22, 1993

Related U.S. Application Data

[63] Continuation of Ser. No. 808,409, Dec. 16, 1991, abandoned.

[30] Foreign Application Priority Data

Dec. 28, 1990 [DE] Germany ..... 9017536 U

[51] Int. Cl.[6] ..... H01R 13/187

[52] U.S. Cl. ..... 439/843; 439/851

[58] Field of Search ..... 439/842, 843, 851–857, 439/861, 862, 848, 839, 833, 59, 62

[56] References Cited

U.S. PATENT DOCUMENTS

| | | | |
|---|---|---|---|
| 3,350,680 | 10/1967 | Benoit et al. | 439/848 |
| 3,380,012 | 4/1968 | Moulin | 439/436 |
| 3,713,080 | 1/1973 | Kennedy | 339/258 R |
| 4,161,346 | 7/1979 | Cherian et al. | 339/17 M |
| 4,560,231 | 12/1985 | Shirai | 339/258 R |
| 4,655,520 | 4/1987 | Shaffer | 439/843 |
| 4,743,205 | 5/1988 | Mutani et al. | 439/845 |
| 4,810,215 | 3/1989 | Kaniko | 439/845 |
| 4,941,836 | 7/1990 | Bormuth | 439/247 |

FOREIGN PATENT DOCUMENTS

| | | | |
|---|---|---|---|
| 0232103 | 8/1987 | European Pat. Off. . | |
| 0241407 | 10/1987 | European Pat. Off. . | |
| 0255245 | 2/1988 | European Pat. Off. . | |
| 0310487 | 4/1989 | European Pat. Off. . | |
| 0352871 | 1/1990 | European Pat. Off. . | |
| 0361010 | 4/1990 | European Pat. Off. . | |
| 2647602 | 11/1990 | France . | |
| 1129580 | 5/1962 | Germany | 439/844 |
| 3335615 | 4/1985 | Germany | 439/78 |
| 2211034 | 6/1989 | United Kingdom | 439/857 |
| 0783893 | 11/1980 | U.S.S.R. | 439/851 |

*Primary Examiner*—David L. Pirlot
*Attorney, Agent, or Firm*—Eric J. Groen

[57] ABSTRACT

A terminal receptacle for receiving a pin or tab therein has a resilient contact portion which prevents the terminal from experiencing frictional corrosion. The receptacle (11) has a receiving portion (17), a mounting portion (19), and a central portion (21). Spring slots (23,25,27) are provided on the central portion (19) thereby allowing the central portion to move resiliently in directions parallel and perpendicular to the axis of the receptacle.

29 Claims, 5 Drawing Sheets

RECEPTACLE FOR A CONNECTOR

This application is a Continuation of application Ser. No. 07/808,409, filed Dec. 16, 1991, now abandoned.

FIELD OF THE INVENTION

This invention relates to a receptacle for an electrical connector comprising a receiving portion for a pin-like or tab-like complementary contact of a complementary connector on a longitudinal end on a receiving side and a mounting portion on the other longitudinal end.

BACKGROUND OF THE INVENTION

Electrical connectors often are situated in an environment where they are exposed to mechanical load caused by shaking or oscillating movement or vibrations and/or stress due to thermal changes. Examples are electrical connectors used in machines or motor vehicles. If such connectors are situated in the engine compartment of a motor vehicle, not only does heavy mechanical load of the above-mentioned kind occur but also high differences in temperature occur especially during wintertime between the motor vehicle at standstill and being driven.

If the two connectors of a connector pair are attached to different parts or components moving relative to each other due to such mechanical and/or thermal stress, a corresponding relative motion between the connectors occurs, for example between contact pins or contact tabs of one connector and the receiving contacts, for example receiving sockets of the other connector of the connector pair. Such relative motion causes frictional corrosion leading to an impairment of the electrical contact between the pin contacts and the socket contacts.

SUMMARY OF THE INVENTION

It is the object of the invention to solve this problem, i.e. to avoid frictional corrosion even in those connector pairs whose connectors move restive to each other due to loads of the above-mentioned kind.

This object is achieved by providing a receptacle for a connector of the above-mentioned kind in which the central portion of the receptacle situated between the two longitudinal ends is resilient in longitudinal direction.

Due to this measure relative motions caused by the loads mentioned above between the receptacle and the complementary contact of a complementary connector are compensated for by the longitudinally resilient property of the receptacle. Even if the above-mentioned loads and the resulting relative motions between the connectors involved occur, the complementary contact and the receiving portion of the receptacle contacting it do not have to move relative to each other. Therefore no frictional motion occurs between them and frictional corrosion can be avoided.

The longitudinally resilient property of the receptacle is dimensioned such that the longitudinal resilience of the receptacle is less than the frictional force between the receiving portion and the complementary contact plugged into the receiving portion.

If the longitudinal resilient property of the receptacle is achieved by measures allowing the resilience of the receptacle transversely to its longitudinal axis, it is advantageous to support the receptacle against such transverse resilient motions.

An embodiment of the invention comprises a box-type receptacle having a rectangular cross section. This receptacle is especially designed for receiving a tab-type complementary contact.

The longitudinally resilient property of the receptacle is achieved by providing its central portion with a plurality of longitudinally spaced, transversely extending spring slots extending in alternating manner from opposing sidewalls of the receptacle to the respective opposing sidewall, possibly extending into the sidewall portion of this sidewall. Thus, on two opposing sides of the receptacle meandering parts of the respective sidewall portion remain. This leads to a scope of resilient motion similar to an accordion.

The transverse motions of the receptacle thus made possible are prevented by a back-up receptacle which is held longitudinally movable to a given extent within the receptacle. This longitudinal movability within the receptacle maintains the longitudinally resilient property. Transverse resilient motions of the receptacle are prevented to a high degree or completely since the back-up receptacle does not follow such transverse motions.

The receptacle and the back-up receptacle can be latched against longitudinal relative motions between them exceeding a given value. A preferred possibility to achieve this is to provide the back-up receptacle in the region of each of its longitudinal ends with a latching window and, after inserting the back-up receptacle into the receptacle, to press wall portions of the receptacle opposed to the latching windows by means of an appropriate embossing tool in such a way into the respectively corresponding latching window that the embossment projection on the receiving side effects a latching free from longitudinal play between the receptacle and the back-up receptacle, the embossment projection on the mounting side, on the other hand, effects a latching allowing longitudinal play.

On the receiving side of the receptacle a contact funnel can be formed by means of contact arms extending into the interior of the receptacle. Preferably the receiving-side end of the back-up receptacle extends to a region under the contact arms so that this receiving-side end of the back-up receptacle is located between the contact arms and the opposing wall portion of the receptacle. From the wall portions of the back-up receptacle situated in the region of the contact arms, back-up springs extend in such a way into the interior of the back-up receptacle that they resiliently support the contact arms. In such an embodiment the back-up receptacle not only supports the receptacle against transversely directed resilient motions, but the contact arms of the receptacle are resiliently supported by the supporting springs of the back-up receptacle as well.

The receptacle can be provided on the receiving side with a contact funnel arranged in its interior and on the mounting side with mounting tongues projecting from its sidewalls in the direction of the longitudinal axis of the receptacle. The mounting tongues are inserted into a circuit board and secured on the surface of the circuit board opposed to the receptacle by bending. If the circuit board is provided with a corresponding through-hole, a complementary contact, for example a tab contact, can be inserted into the receptacle from both sides of the circuit board.

DETAILED DESCRIPTION OF THE INVENTION

Figure 1:
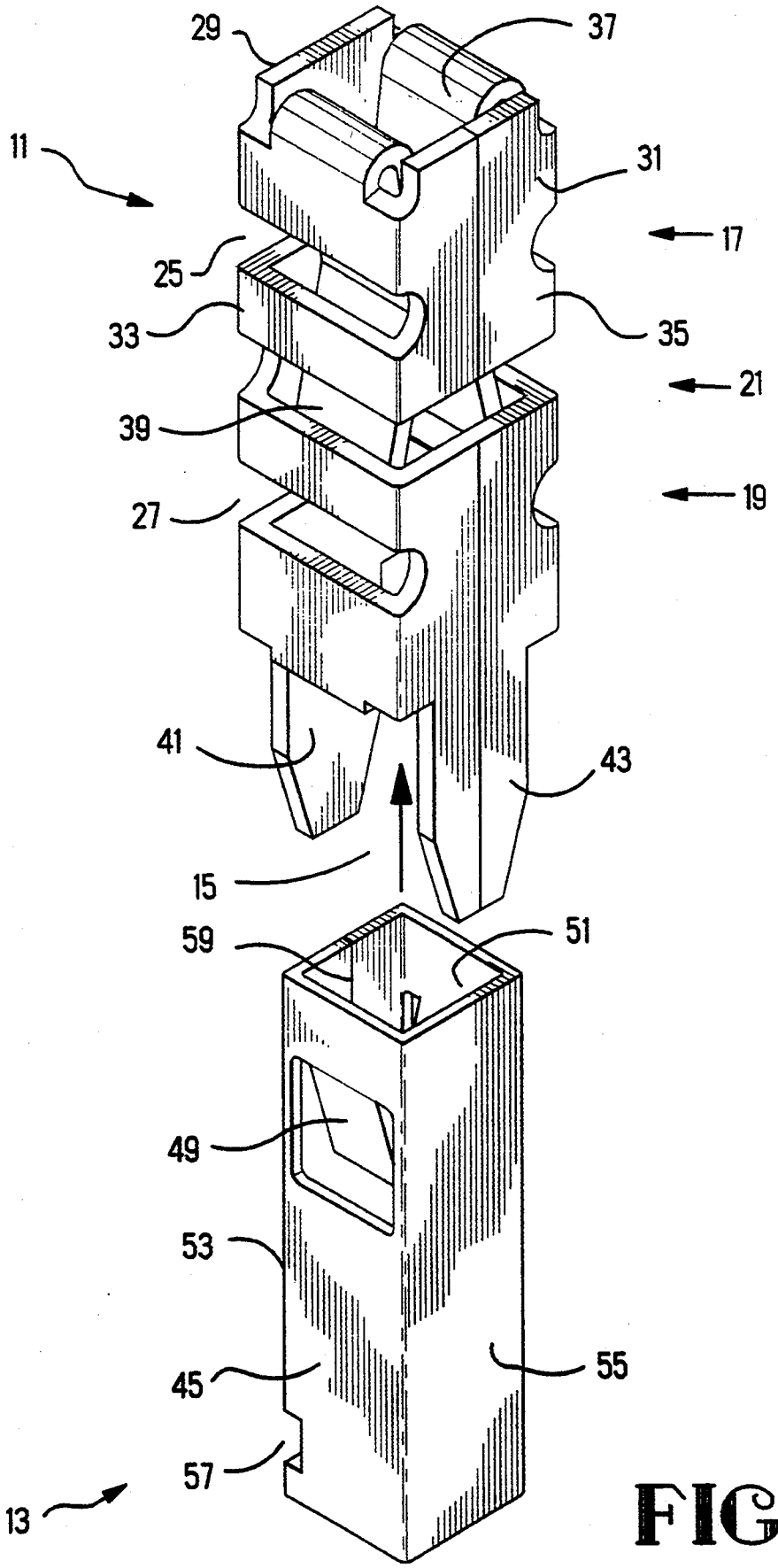
FIG. 1 is a perspective view of a combination of a receptacle and a back-up receptacle according to the invention before joining.

FIG. 1 shows a perspective diagonal view of a receptacle 11 and a back-up receptacle 13 before joining. Both are formed box-like having a rectangular, substantial].y square cross section. As indicated by an arrow 15 the back-up receptacle 13 is inserted into the receptacle 11.

Both the receptacle 11 and the back-up receptacle 13 are punched and formed from a single piece of sheet metal each.

The receptacle 11 has at its longitudinally upper end in FIG. 1 a receiving portion 17 and at its lower end a mounting portion 19. A central portion 21 of the receptacle 11 is provided with an intermediate spring slot 23, a receiving-side spring slot 25 and a mounting-side spring slot 27. These tree spring slots are spaced apart in the longitudinal direction of the receptacle 11 and extend transversely to the longitudinal direction in an alternating manner from opposing sidewalls 29 and 31 to the respective opposing sidewall 31 to 29, respectively. In doing so the spring slots extend into the sidewall portions of the respective opposing sidewall 29 to 31, respectively. Each of the slots 23 to 27 is U-shaped, the base of the U separating one of the sidewalls 29 and 31 and the legs of the U separating the remaining sidewalls 33 or 35, respectively adjacent to that sidewall. As a result of the opposed orientation of each two adjacent spring slots the remaining parts of the remaining sidewalls 33 and 35 are given a meander-like shape. Thus the receptacle 11 is able to perform resilient upsetting and lengthening movements similar to the movements of an accordion.

Similar to an accordion, however, due to the spring slots 23 to 27 the receptacle 11 is able to move resiliently in transverse direction as well, i.e. in a transverse direction to the longitudinal axis of the receptacle 11. Such transverse movements are borne up and totally or to a great extent prevented by the back-up receptacle 13, since the back-up receptacle 13 is rigid in itself so that it cannot follow the resilient movements of the receptacle 11.

The receptacle 11 is provided in its receiving portion 17 with contact arms 37 and 39 projecting from the receiving-side end of the remaining sidewalls 33 and 35, which are bent into the interior of the receptacle 11. Both these contact arms 37 and 39 form a contact funnel and serve as contact springs for a tab-like contact (not shown) inserted into the receiving portion 17.

On the mounting-side end of the receptacle 11 projects from each of the two sidewalls 29 and 31 a mounting tongue 41 and 43, respectively, which can be inserted into correspondingly formed receiving holes in a circuit board 81.

If the circuit board 81 is provided with a corresponding through-hole (not shown), a complementary contact, preferably a tab-like contact, can be inserted through the circuit board 81 into the contact funnel from the mounting side 19.

The back-up receptacle is provided with back-up springs 49 and 51, respectively, at each of two sidewalls 45 and 47 being opposed to the remaining sidewalls 33 and 35 after inserting the back-up receptacle 13 into the receptacle 11. The back-up springs 49,51 obliquely project from the corresponding sidewall 45 or 47, respectively, into the interior of the back-up receptacle 13.

One of the two remaining sidewalls 53 and 55 of the back-up receptacle is provided with a mounting-side latching window 57 in the region of its mounting-side end. In the embodiment shown in FIG. 1 the latching window 57 is formed in the sidewall 53 having a seam 59. Moreover the back-up receptacle 13 is provided with a receiving-side latching window 61 not shown in FIG. 1 in the region of its receiving-side end. This window is shown in FIG. 3.

Figure 2:
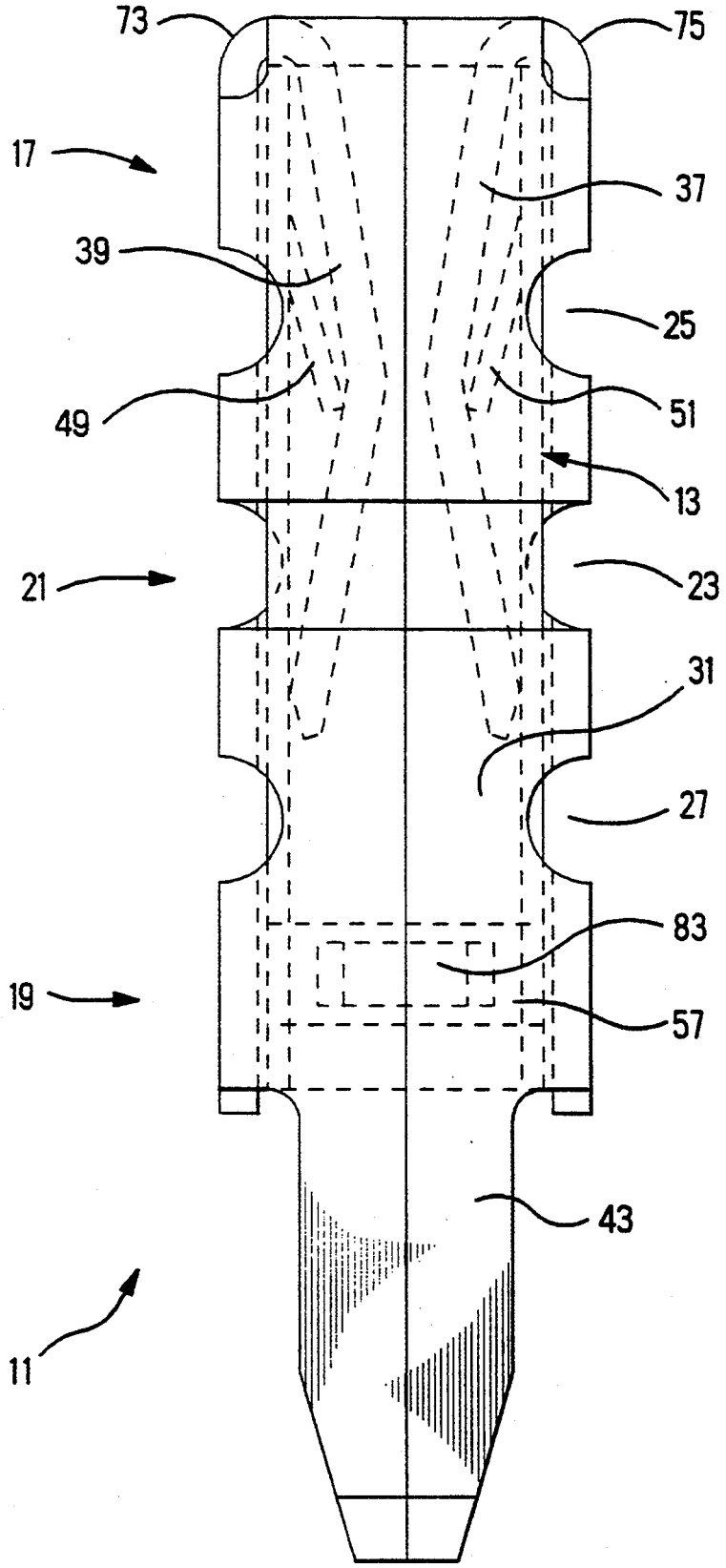
FIG. 2 is a side view of the receptacle shown in FIG. 1 with inserted back-up receptacle.
Figure 3:
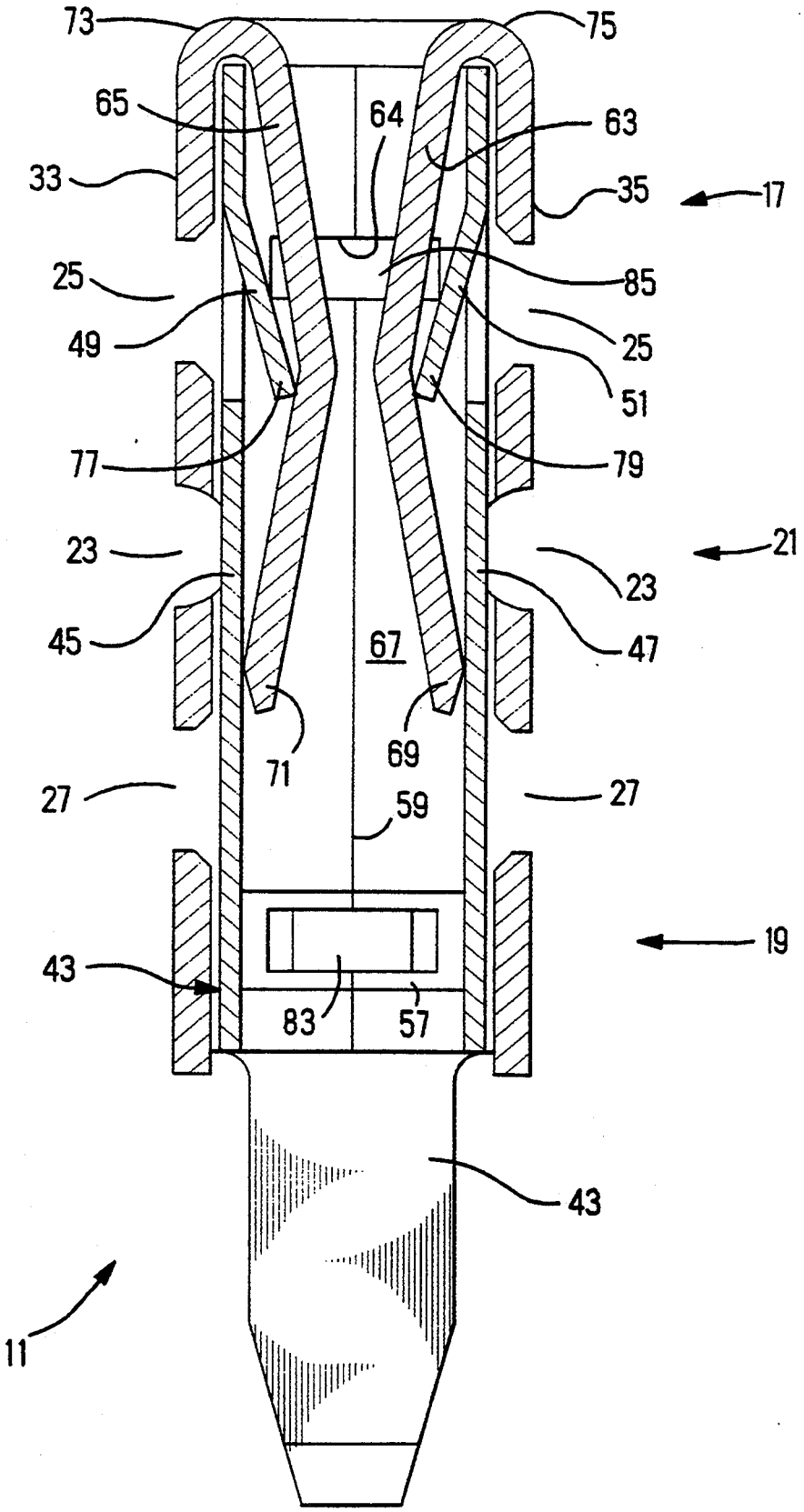
FIG. 3 is a longitudinal sectional view of FIG. 2.

FIGS. 2 to 5 show different views of the receptacle 11 with the back-up receptacle 13 inserted in it. FIGS. 2 and 3 show the arrangement of receptacle 11 and back-up receptacle 13 as seen from the same side, FIG. 2 showing a side view presenting in broken lines the portions of the back-up receptacle 13 not visible from outside, and FIG. 3 showing a longitudinal sectional view.

As shown in FIGS. 1 to 3 the contact arms 37 and 39 of the receptacle 11 form a contact funnel wherein upper portions 63 and 65 of the two contact arms 37 and 39 converge to a narrow 67 and the free portions of the contact arms 37 and 39 situated below the narrow 67 diverge, their free ends 69 to 71, respectively contacting the respective opposing sidewall 45 or 47 of the back-up receptacle 13. The receiving-side end of the back-up receptacle 13 extends between the contact arms 37 and 39 up to foldings 73 and 75 between the sidewalls 33 and 35 and the contact arms 37 and 39 of the receptacle 11.

Free ends 77 and 79 of the back-up springs 49 and 51 are in contact with the outer sides of the contact arms 37 and 39 shortly below the narrow 67. Upon insertion of a tab-like contact (not shown) from the receiving side of the receptacle 11 into the contact funnel formed by the contact arms 37 and 39 the central portions of the contact arms 37 and 39 support on the free ends 77 and 79 of the back-up springs 49 and 51 and the free ends 69 and 71 of the contact arms 37 and 39 support on the sidewalls 45 and 47 of the back-up receptacle 13. The result is a resilient support of the contact arms 37 and 39 and thus a raised resilient contact force acting upon the inserted tab-like contact.

Figure 4:
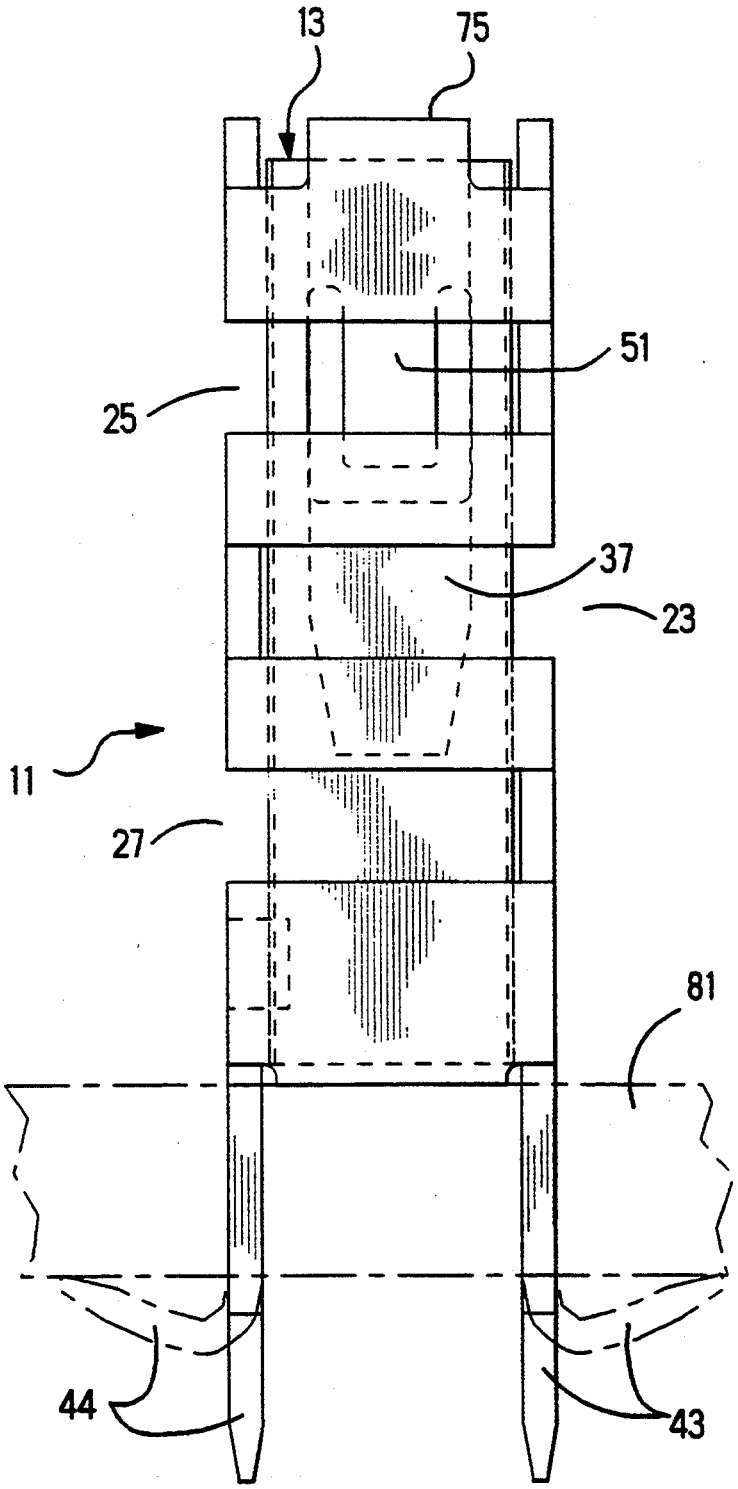
FIG. 4 is a side view of a receptacle and a back-up receptacle inserted in it which is rotated by 90° with respect to the view in FIG. 2.

FIG. 4 shows a side view of the combination of the receptacle 11 and the back-up receptacle 13 inserted in it rotated by 90° with respect to the side view shown in FIG. 2. In this Figure a circuit board 81 is indicated having passages through which the mounting tongues 41 and 43 of the receptacle 11 are inserted. By dot-and-dash lines a position of the mounting tongues 41 and 43 is illustrated in which their portions projecting below the circuit board 81 are bent sideways to the underside of the circuit board 81. Thus the receptacle 11 is mounted on the circuit board 81.

The mounting tongues 41 and 43 are usually pressed into the corresponding openings of the circuit board 81 by pressing by means of an inserting tool onto the receiving-side end of the receptacle 11, i.e. particularly on the receiving-side ends of the sidewalls 29 and 31 not having contact arms 37 and 39. Thus bending or damage of the contact arms 37 and 39 during the press-in process is prevented. If the back-up receptacle 13 were freely movable in longitudinal direction within the receptacle 11, the mounting-side end of the back-up receptacle 13 would abut on the circuit board 81 during this press-in process. During the continuation of the press-in process the receiving-side end of the back-up receptacle 13 would press against the inner portion of the foldings 73 and 75. Due to its longitudinal resilience, the receptacle 11 would be increasingly compressed with the continuation of the press-in process. As a result the receiving-side end of the back-up receptacle 13 would press increasingly on the foldings 73 and 75. This would lead to an undesirable bending of the contact arms and/or the receiving-side end of the back-up receptacle 13.

According to the invention this is prevented by latching the receptacle 11 and the back-up receptacle 13 in the region of their receiving-side ends free of longitudinal play and in the region of their mounting-side ends having longitudinal play. For this purpose the receiving-side latching window 57 and the mounting-side latching window 61 are provided in a sidewall of the back-up receptacle 13. Into the two latching windows 57 and 61 a mounting-side embossment projection 83 or a receiving-side embossment projection 85, respectively are pressed in from the respective portions of the opposing sidewall 29 of the receptacle 11. In doing so, the receiving-side embossment projection 85 essentially fills the receiving-side latching window 61 completely, at least as seen in longitudinal direction of the receptacle 11 and the back-up receptacle 13, while the mounting-side embossment projection 83 fills the mounting-side latching window 57 only partially, again as seen in longitudinal direction of the receptacle 11 and the back-up receptacle 13. Thus a latching free of longitudinal play between the receiving-side embossment projection 85 and the receiving-side latching window 61 is effected, while relative motion in longitudinal direction of the receptacle 11 and the back-up receptacle 13 is still possible between the mounting-side embossment projection 83 and the mounting-side latching window 57. The longitudinal play between the mounting-side embossment projection 83 and the mounting-side latching window 57 is chosen in such a way that a longitudinal relative motion of a predetermined maximum length is possible between the receptacle 11 and the back-up receptacle 13, if a longitudinal relative motion between the receptacle 11 and the back-up receptacle 13 occurs due to longitudinally resilient motions of the receptacle 11.

To allow an expanding resilient motion as well as a compressing or upsetting resilient motion of the receptacle 11 out of a neutral position, the mounting-side embossment projection 83 is positioned in the middle of the mounting-side latching window 57.

Due to the latching between the receiving-side embossment projection 85 and the receiving-side latching window 61 allowing no longitudinal play, no relative motion between the receiving-side end of the back-up receptacle 13 and the foldings 73 and 75 occurs even if the receptacle 11 resiliently moves in longitudinal direction. Thus these portions of the receptacle 11 and the back-up receptacle 13 cannot be moved relative to each other during the press-in process of the mounting tongues 41 and 43 into the receiving holes of the circuit board 81.

In the embodiment shown in FIG. 3 the two latching windows 57,61 and the two embossment projections 83 and 85 are formed at the same sidewall of the back-up receptacle 13 or the receptacle 11, respectively. However, the receiving-side latchings and the mounting-side latchings can be formed at different sidewalls, preferably at opposing sidewalls, or at sidewalls each opposed to another.

Figure 5:
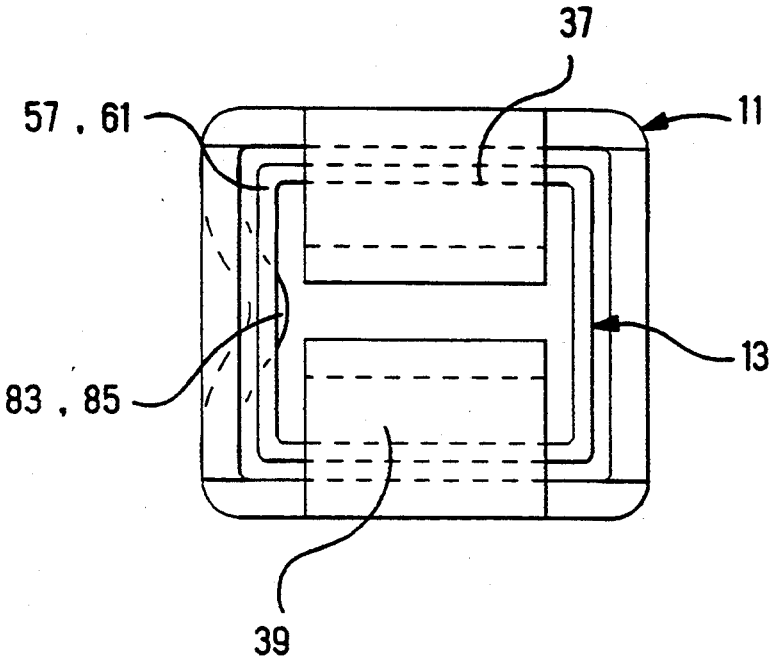
FIG. 5 is a receiving-side plan view of the receptacle with the back-up receptacle inserted.

FIG. 5 shows a plan view of the receptacle 11 with the back-up receptacle 13 inserted in it as seen from the receiving side. This view shows on the one hand the tight arrangement of the sidewalls of the back-up receptacle 13 close to the inner walls of the receptacle 11. On the other hand, it shows the embossment projections 83 and 85 pressed into the latching windows 83 and 85.

Figure 6:
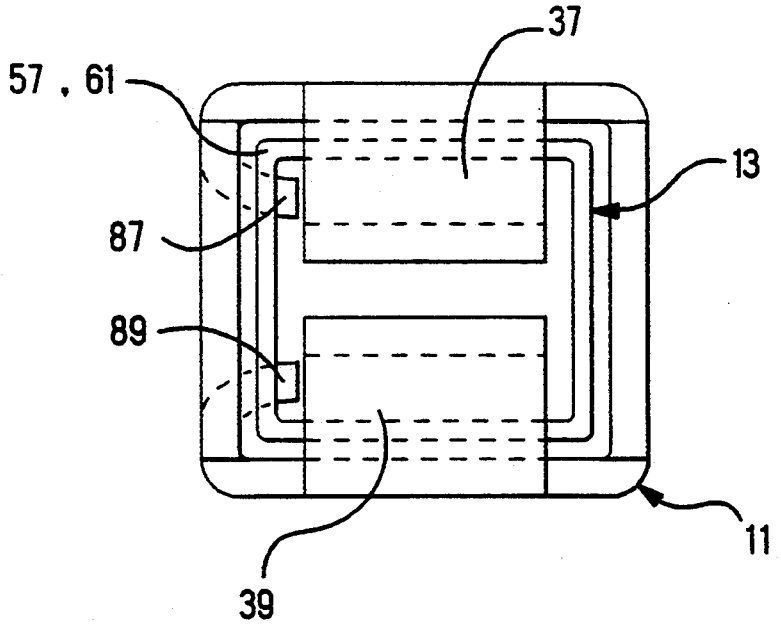
FIG. 6 is a plan view as shown in FIG. 5 of a modified embodiment of the invention.

FIG. 6 shows an embodiment of the invention which is a modification of the above-described embodiment with respect to the embossment projections of the receptacle 11. This embodiment is modified in that no embossment projections project into the latching windows 57 and 61, but latching brackets 87 and 89 which are bent from the corresponding sidewall of the receptacle 11 into its interior and are inserted into the corresponding latching window. From this Figure it cannot be seen that the latching brackets 87 and 89 cooperating with the receiving-side latching window 61 have the same height as the latching window 61 as seen in longitudinal direction of the receptacle 11 and the back-up receptacle 13, while the latching brackets 87,89 cooperating with the mounting-side latching window 57 have a height in this longitudinal direction which is less than the height of the receiving-side latching window 57 according to the predetermined longitudinal play between the receptacle 11 and the back-up receptacle 13.

In this modified embodiment, too, the latching is only formed after the back-up receptacle 13 has been inserted into the receptacle 11. Only then the latching brackets 87,89 are pressed into the respectively corresponding latching window.

Changes in construction will occur to those skilled in the art and various apparently different modifications and embodiments may be made without departing from the scope of the invention. The matter set forth in the foregoing description and accompanying drawings is offered by way of illustration only. It is therefore intended that the foregoing description be regarded as illustrative rather than limiting.

I claim:

1. A box-type receptacle for an electrical connector, comprising a receiving portion for a pin-like or tab-like complementary contact of a complementary connector on a longitudinal end on a receiving side and a mounting portion on another longitudinal end, the receiving portion having at least one contact extending into an interior section of the receptacle, a central portion of the receptacle located between said longitudinal end and said other longitudinal end is resilient in longitudinal direction, the central portion is provided with at least one transversely extending slot, the contact being profiled such that the longitudinal resilience of the receptacle is less than the frictional force between the receiving portion and the complementary contact plugged into the receiving portion so that the receiving portion and the complementary contact float together without relative movement therebetween.

2. A receptacle according to claim 1 wherein a pair of mounting pins or mounting tongues projects from the longitudinal end on the mounting side, which is adapted to be mounted in corresponding holes of a circuit board in electrical contact establishing manner.

3. A receptacle according to claim 1 wherein the receptacle is open both on the receiving side end and on the mounting side end, such that a complementary contact is insertable into said receptacle either from the receiving side end or from the mounting side end.

4. The box-shaped receptacle contact of claim 1, wherein the central portion of the receptacle is tubular.

5. A receptacle according to claim 1 wherein a plurality of contacts springs extending from the longitudinal end on the receiving side are provided constituting together a contact funnel for a complementary contact.

6. A receptacle according to claim 5 wherein the contact funnel is constituted by two contact arms extending into the interior of the receptacle from two opposing sidewalls of the longitudinal end on the receiving side.

7. A receptacle according to claim 1 wherein the central portion of the receptacle is provided with a plurality of longitudinally spaced, transversely extending spring slots extending in alternating manner from opposing sidewalls of the receptacle to respective opposing sidewalls.

8. A receptacle according to claim 7 wherein said spring slots extend into the sidewall portions of the respective opposing sidewalls.

9. A box-type receptacle having a substantially rectangular cross-section for electrical connection to a tab-like complementary contact, the receptacle comprising a receiving portion at a longitudinal end for receiving the complementary contact, and a mounting portion on another longitudinal end, the receiving portion having a pair of opposed contact arms extending therefrom and bent into an interior of the receptacle, the receptacle comprising a central portion joining the mounting portion to the receiving portion and enclosing the interior of the receptacle, the central portion comprising a plurality of longitudinally spaced, transversely extending spring slots extending in alternating manner from opposing sidewalls of the receptacle to the respective opposing sidewall, the spring slots dimensioned to provide a longitudinal resilience of the receptacle that is less than the frictional force between the receiving portion and the complementary contact so that the receiving portion and the complementary contact float together without relative movement therebetween.

10. The receptacle of claim 9, further comprising a back-up receptacle fixedly attached to the receiving portion and comprising a member for limiting longitudinal resilient movement of the receptacle by a predetermined amount.

11. A box-shaped receptacle for the receipt of a tab terminal, the receptacle having a plurality of longitudinally stacked band sections extending from a fixed mounting portion, where the adjacent band sections are interconnected at one side wall, providing resilient longitudinal movement of the band sections relative to each other, where one of the band sections is provided with a contact section adapted for making contact with the tab and engaging the tab with a retention force that exceeds the resilient force of the bad sections so that the contact section and the tab float together without relative movement therebetween.

12. The box-shaped receptacle of claim 11, further comprising a conductor contacting section extending from an opposite end of said fixed mounting section.

13. The box-shaped receptacle of claim 11, further comprising a back-up spring receptacle mounted coaxially of said box-shaped receptacle to rigidify said box-shaped receptacle.

14. The box-shaped receptacle of claim 11, wherein the contact section is provided on the outermost band section.

15. The box-shaped receptacle of claim 14, wherein the contact section is formed by two cantilever beam spring arms being reversely bent within an interior of at least the outermost band portion.

16. The box-shaped receptacle contact of claim 1, wherein the central portion has a closed box shape.

17. The box-shaped receptacle contact of claim 16, wherein the closed box has a rectangular cross-section formed of adjacent sidewalls.

18. The box-shaped receptacle contact of claim 11, wherein the stacked band sections have a closed-circumference cross section.

19. The box-shaped receptacle contact of claim 18, wherein the band sections have a rectangular cross section.

20. A receptacle according to claim 1 further comprising a support member to support said receptacle against resilient motions transversely of the longitudinal direction thereof.

21. A receptacle according to claim 20 wherein the support member comprises a back-up receptacle positioned coaxially of said box type receptacle against transverse resilient motions of the receptacle, and in that the back-up receptacle is held in said receptacle so as to be longitudinally movable relative to said receptacle.

22. A receptacle according to claim 21 wherein the receptacle and the back-up receptacle are provided with a motion limiting means for limiting the longitudinal relative motion between said back-up receptacle and said receptacle.

23. A receptacle according to claim 22 wherein said motion limiting means has, in the region of each longitudinal end of receptacle and back-up receptacle, at least one latching recess in a sidewall of the back-up receptacle and at least one latching projection projecting into said latching recess from the wall portion of the receptacle opposite said latching recess, and in that the latching projection on the receiving side, as seen in the longitudinal direction of said receptacle, is snugly seated in the associated latching recess and the latching projection on the mounting side is seated with longitudinal play in the associated latching recess.

24. A receptacle according to claim 23 wherein the latching recesses are each constituted by a latching window in the sidewall of the back-up receptacle and the latching projections are each constituted by an embossment projection formed after insertion of the back-up receptacle into said receptacle and pressed into the respective latching window that the embossment projection on the receiving side, as seen in the longitudinal direction of receptacle and back-up receptacle, has substantially the same longitudinal dimension as the associated latching window, and in that the embossment projection on the mounting side, as seen in the longitudinal direction of receptacle and back-up receptacle, has a longitudinal dimension which is shorter than the longitudinal dimension of the associated latching window by a predetermined amount corresponding to the predetermined longitudinal play, the embossment projection on the receiving side being seated substantially centrally in the associated latching window when the resilient receptacle is in its unstressed resting condition.

25. A receptacle according to claim 21 wherein the receptacle is formed with contact springs, the back-up receptacle extends as far as into the region between the contact springs and their opposing sidewall portions of the receptacle and supports the contact springs upon resilient motion thereof in the direction towards the opposing sidewall.

26. A receptacle according to claim 25 wherein a back-up spring projects from each of the sidewall portions opposite said contact springs into the interior of said back-up receptacle, the associated contact spring, upon insertion of a complementary contact into the contact funnel, being adapted to be resiliently supported by said back-up spring.

27. A receptacle according to claim 26 wherein the opposing contact springs in longitudinal section of said receptacle, together constitute a substantially X-shaped contact funnel, and in that on the one hand the free ends of the back-up springs support the respective opposing contact spring in the region of the narrow portion of the X-shape and on the other hand the free ends of the contact springs are each supported on the opposing wall portion of the back-up receptacle.

28. A receptacle according to claim 27 wherein the receptacle and the back-up receptacle are of substantially rectangular cross-section.

29. A receptacle for an electrical connector, comprising a receiving portion for a pin-like or tab-like complementary contact of a complementary connector on a longitudinal end on a receiving side and a mounting portion on another longitudinal end, a central portion of the receptacle located between said longitudinal end and said other longitudinal end is resilient in longitudinal direction, provided with at least one transversely extending spring slot, whereby the longitudinal resilience of the receptacle is less than the frictional force between the receiving portion and the complementary contact plugged into the receiving portion so that the receiving portion and the complementary contact float together without relative movement therebetween, the receptacle is open both on the receiving side end and on the mounting side end, such that a complementary contact is insertable into said receptacle either from the receiving side end or from the mounting side end.

* * * * *